United States Patent [19]

Arriola, Jr.

[11] 4,039,157

[45] Aug. 2, 1977

[54] METAL BAND USE FACILITATING ASSEMBLY

[76] Inventor: Pedro R. Arriola, Jr., 2440 Ave. "B, Port Arthur, Tex. 77640

[21] Appl. No.: 704,913

[22] Filed: July 12, 1976

[51] Int. Cl.[2] ..... B21C 47/16

[52] U.S. Cl. ..... 242/78.7; 242/68.7

[58] Field of Search ..... 242/78.1, 78.7, 68.7, 242/54 R, 58

[56] References Cited

U.S. PATENT DOCUMENTS

| | | | |
|---|---|---|---|
| 1,076,073 | 10/1913 | Stanbon | 242/68.7 |
| 2,207,663 | 7/1940 | Glasner | 242/78.7 |
| 2,601,560 | 6/1952 | Riemenschneider | 242/58 X |
| 2,928,622 | 3/1960 | Herr | 242/78.1 X |
| 3,955,772 | 5/1976 | Chisholm | 242/78.7 |

*Primary Examiner*—Edward J. McCarthy

*Attorney, Agent, or Firm*—Clarence A. O'Brien; Harvey B. Jacobson

[57] ABSTRACT

A metal band use facilitating assembly has a frame on which a metal band roll receiving receptacle is supported. Also supported on the frame is a band rewinder which permits a length of banding material cut from a roll disposed in the receptacle to be rewound and formed into a smaller, more manageable roll of the banding material.

11 Claims, 7 Drawing Figures

Fig. 3
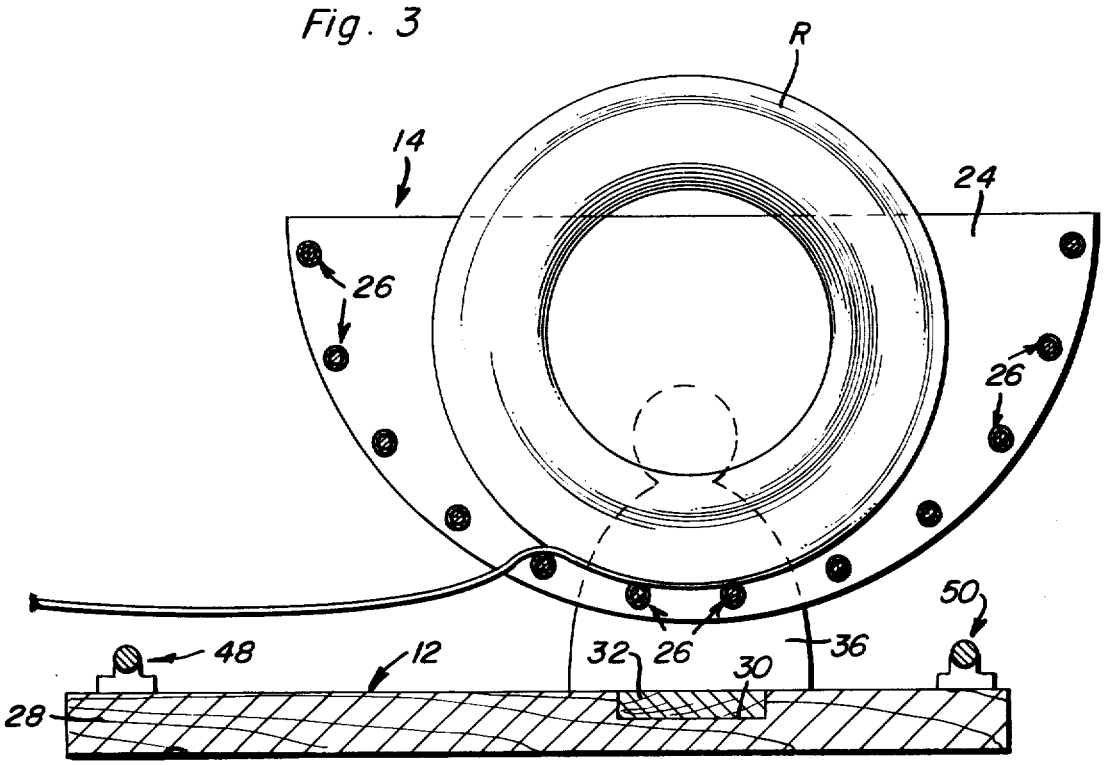
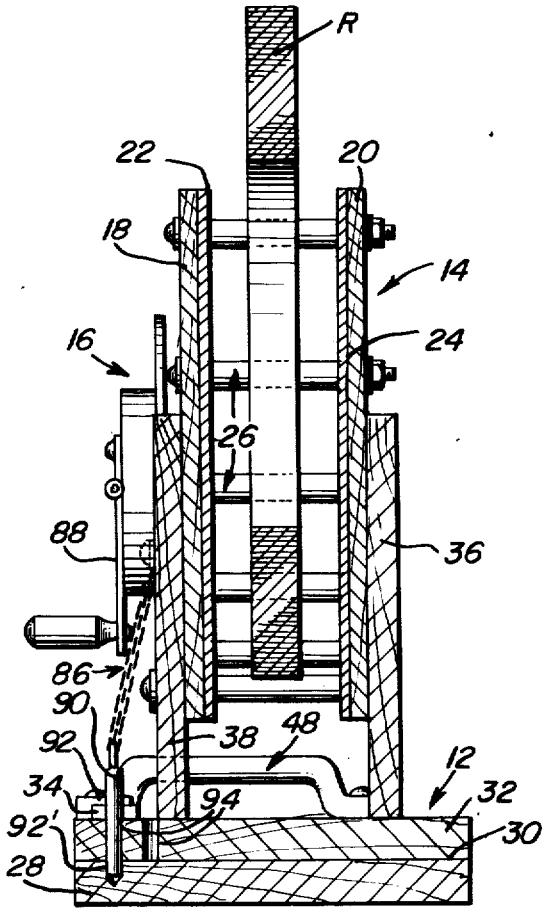
Fig. 4

METAL BAND USE FACILITATING ASSEMBLY

BACKGROUND OF THE INVENTION

1. Field of the Invention

This invention relates generally to dispensing equipment for metal banding material of the kind used for strapping together various elements, and particularly to a combination device used for facilitating the handling of such banding material.

2. Description of the Prior Art

It is frequently necessary, as when installing industrial insulators, and the like, to make use of metal banding material in order to secure various elements in a desired position or to attach a plurality of elements to one another. This banding material generally comes in rather bulky and heavy rolls, and it is customary to put such rolls into a dispensing device in order to permit more manageable lengths of the banding material to be cut from the roll. Once a length of the banding material has been cut, however, it is usually necessary to re-roll the length of cut material by hand in order to make the length of material manageable as a workman moves around a construction site, and the like.

Dispensers for metal bands, and similar banding material, are generally well known, and examples of such dispensers can be found in U.S. Pat. No. 425,011, issued Apr. 8, 1890, to J. Talbert; U.S. Pat. No. 1,239,960, issued Sept. 11, 1917, to E. L. Pohlman; U.S. Pat. No. 2,833,489, issued May 6, 1958, to M. B. Hall; and U.S. Pat. No. 3,006,570, issued Oct. 31, 1961, to R. Boser.

SUMMARY OF THE INVENTION

It is an object of the present invention to provide an assembly for facilitating the dispensing and rewinding of a length of banding material.

It is another object of the present invention to provide an integrated assembly which is simple yet rugged and reliable of construction, and permits the forming of rolls of banding material of manageable size in a more expedient manner than the prior art device and techniques.

These and other objects are achieved according to the present invention by providing a metal band use facilitating assembly having: a frame arranged for cooperatively supporting the various working units of the assembly; a receptacle supported on the frame for receiving individually rolls of banding material of various widths and diameters; and a band rewinding arrangement supported on the frame for winding predetermined lengths of banding material into rolls of more manageable size than the basic roll disposed in the receptacle.

The receptacle preferably includes first and second semi-circular side walls having opposed surfaces and mounted in spaced relation on the frame, with the opposed surfaces of the side walls being constructed from a low-friction material. A plurality of tube rollers are disposed between the side walls of the receptacle for supporting a roll of banding mterial and facilitating pulling of the banding material out of the receptacle. By this arrangement, the roll of banding material rests entirely on the tube rollers, thus eliminating a need for adjustment of the dispenser formed by the receptacle in order to accommodate rolls of different diameters.

Further, a particularly advantageous feature of the present invention permits adjustment of the side walls of the dispensing receptacle to be adjusted so as to accommodate various widths of banding material by provision of a slide disposed in a mating recess provided in a base member partially forming the frame of the assembly. First and second upstanding support members are affixed to the base member and the slide, respectively, for permitting relative movement therebetween by movement of the slide, with the side walls of the receptacle being mounted on the support members. By this arrangement, movement of the slide will cause the space between the side walls of the receptacle to vary, thus permitting the receptacle to be adjusted to the width of any banding material being employed.

The band rewinding arrangement includes a band rewinder and a tape dispenser. The latter provides an adhesive tape for securing an end of a roll formed on the rewinder to the remainder of the roll in order to prevent the newly formed, more manageable roll from unwinding until same is used by the installer. According to a preferred construction of the invention, both the band rewinder and the tape dispenser are mounted directly on a side wall of the dispensing receptacle. The frame advantageously further includes a pair of generally arcuate handles arranged extending transversely of a longitudinal extent of the base member and away from the base member in the same direction which extend the support members. One of the handles is offset toward that side of the base member which is adjacent the support member on which the band rewinder is mounted. In this manner, the offset one of the handles forms a guide for banding material being rewound on the band rewinder.

The band rewinder advantageously includes a spool rotatably mounted on the associated side wall of the dispensing receptacle, and is provided with a slot for receiving an end of the band to be rewound. This spool is advantageously constructed from a pair of half sections, with one of the half sections being affixed about an axis of rotation of the spool, and the other of the half sections being resiliently mounted in order to tension the length of banding material being rewound. A handle is affixed to the spool for rotating same.

A stop pin is advantageously provided on the frame for selectively engaging with one of a plurality of holes provided in the slide which is in alignment with an aperture provided in the base member for restraining the slide from movement. This stop pin may also be employed in conjunction with a through window provided in the band rewinder for holding the latter device against rotation.

These together with other objects and advantages which will become subsequently apparent reside in the detals of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a fragmentary, sectional view taken generally along the line 3—3 of FIG. 1.

FIG. 4 is a sectional view taken generally along the line 4—4 of FIG. 2.

DESCRIPTION OF THE PREFERRED EMBODIMENTS

Figure 1:
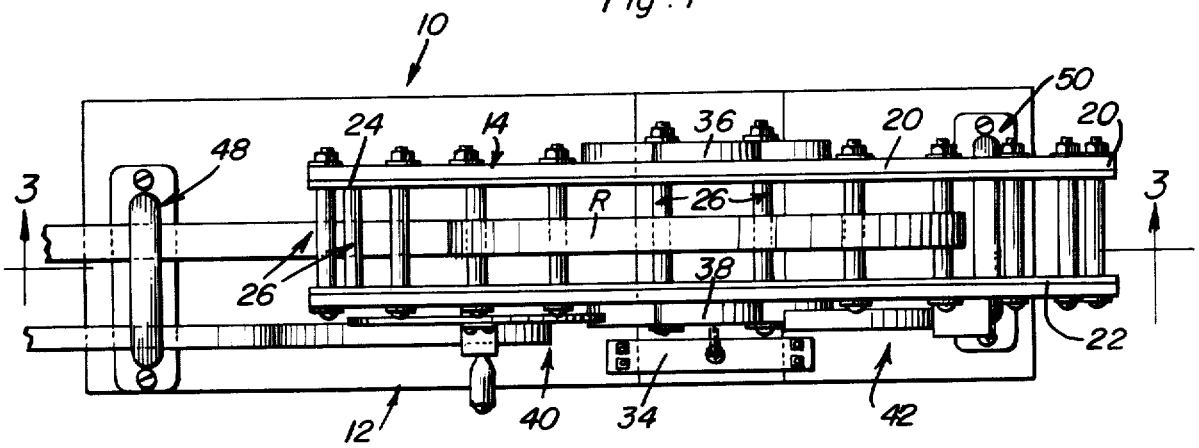
FIG. 1 is a fragmentary, top plan view showing an assembly according to the present invention.
Figure 2:
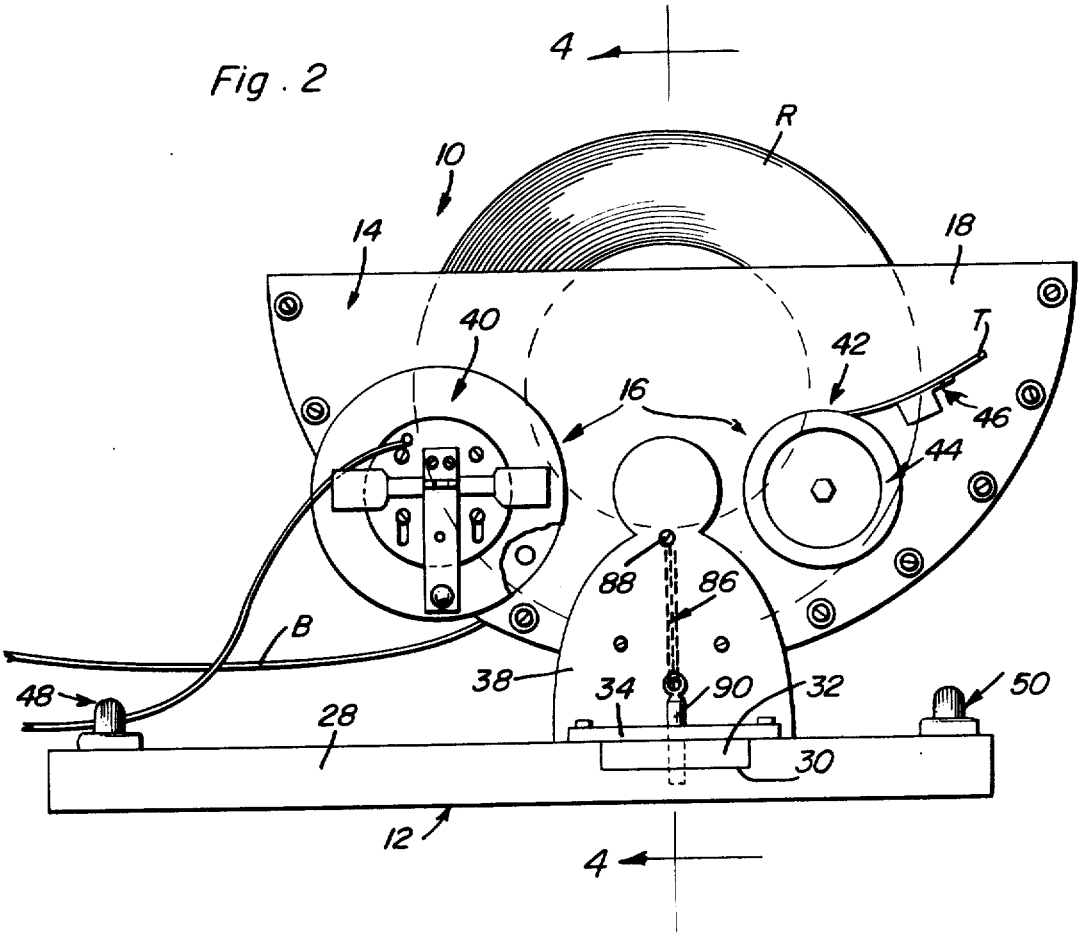
FIG. 2 is a fragmentary, side elevational view showing the assembly of FIG. 1.

Referring now more particularly to FIGS. 1 through 4 of the drawings, a metal band use facilitating assembly 10 according to the invention includes band dispensing, band rewinding, and adhesive tape dispensing units formed into an integrated assembly. The latter includes a frame sub-assembly 12 which supports the various units of the assembly. Among the units supported on the frame 12 is a dispensing receptacle 14 disposed for receiving individually rolls R of suitable banding material, such as a metal strip, of various widths and diameters. Also supported by frame sub-assembly 12 is a band rewinder arrangement 16 for winding banding material into rolls of more manageable size.

Receptacle 14 includes first and second semi-circular side walls 18 having opposed surfaces and mounted in spaced relation on the frame sub-assembly 12. The opposed surfaces of side walls 18 and 20 are advantageously in the form of the illustrated semi-circular plates 22 and 24 constructed from a low-friction material, such as steel, and the like. A plurality of tube rollers 26 are disposed extending between the side walls 18 and 20 for supporting a roll R of banding material in such a manner as to facilitate pulling of the banding material out of receptacle 14.

The frame sub-assembly 12 further includes a longitudinally extending base member 28 provided with a generally rectangular recess 30 disposed transversely of the longitudinal extent of member 28. A slide 32, also preferably of generally rectangular configuration, is movably arranged in recess 30, with an anchor plate 34 being attached to base member 28 in such a manner as to extend longitudinally over slide 32 for retaining the latter in recess 30. It is to be understood that other arrangements for retaining slide 32, such as using slanted side walls (not shown) can be employed to retain slide 32 in recess 30, but the use of anchor plate 34 is preferred for reasons which will become clear below. First and second upstanding support members 36 and 38 are provided on base member 28, with support member 36 being affixed to base member 28 in such a manner as to straddle recess 30, and support member 38 being aligned substantially parallel to support member 36 and affixed to slide 32 for movement transversely of the longitudinal extent of base member 28 in order to vary the spacing between the support members 36 and 38. Side walls 18 and 20 are mounted on the support members 38 and 36, respectively, so that side wall 18 will move with support member 36 in order to vary the spacing between the side walls 18 and 20. The tube rollers 26 are arranged so that side wall 18 may slide over the outer surface of these rollers.

The band rewinder arrangement 16 includes a band rewinder 40 and a tape dispenser 42. The latter provides an adhesive tape of conventional construction which permits securing of an end of a roll rewound on rewinder 40 to the roll itself in order to retain the length of band B cut from roll R to be retained as a smaller, more manageable roll until the smaller roll is ready for use. Tape dispenser 42 may include a reel 44 of conventional construction mounted on side wall 18 of receptacle 14 and having disposed in proper relationship therewith a conventional cutter 46, also mounted on side wall 18. Further, the band rewinder 40 is advantageously mounted on side wall 18 as well, not only to place both the rewinder 40 and dispenser 42 side by side on the assembly 10, but for purposes which will become clear below.

Frame sub-assembly 12 further includes a pair of arcuate handles 48 and 50 arranged extending transversely of the longitudinal extent of base member 28 and away from the upper surface of the base member 28 in the same direction as extend the support members 36 and 38. One of the handles, namely handle 48, is offset toward the side of the base member 28 which is adjacent the support member 38 which supports the side wall 18 on which the band rewinder 40 is mounted, so that the handle 48 forms a guide for the length of banding material designated B which is being rewound on the band rewinder 40.

Figure 5:
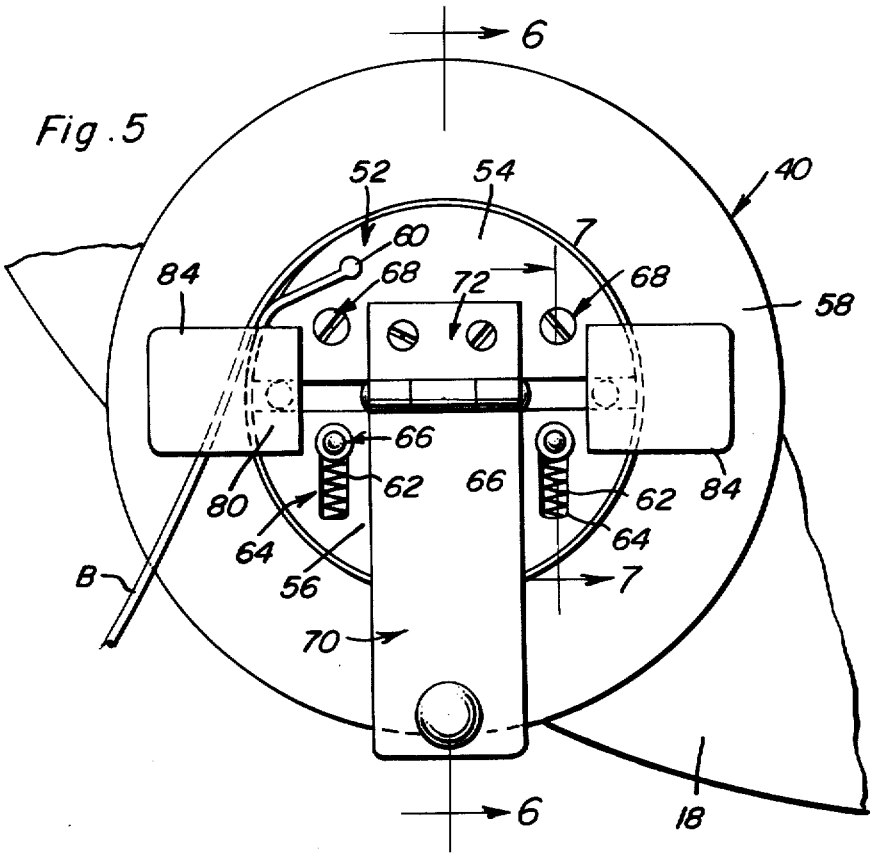
FIG. 5 is a fragmentary, enlarged, side elevational view showing the left-hand portion of the assembly as seen in FIG. 2.
Figure 6:
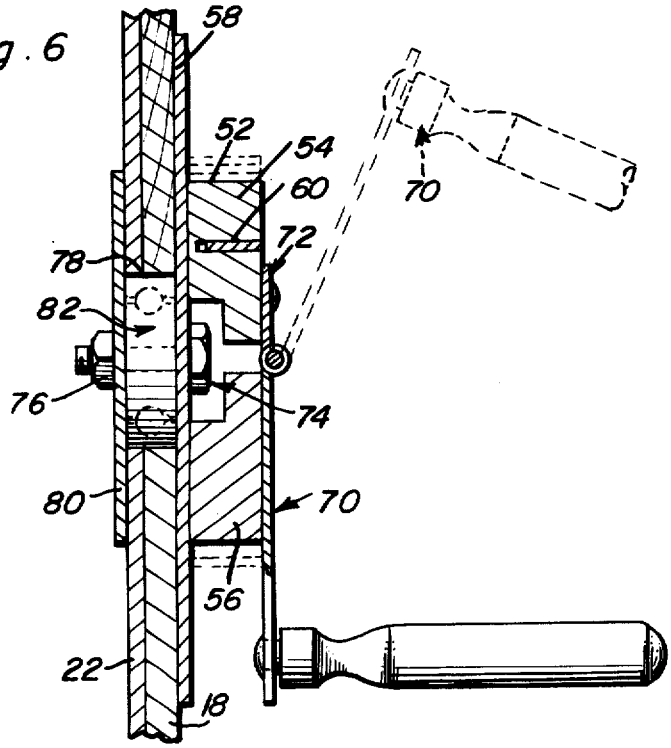
FIG. 6 is a fragmentary, enlarged sectional view taken generally along the line 6—6 of FIG. 5.
Figure 7:
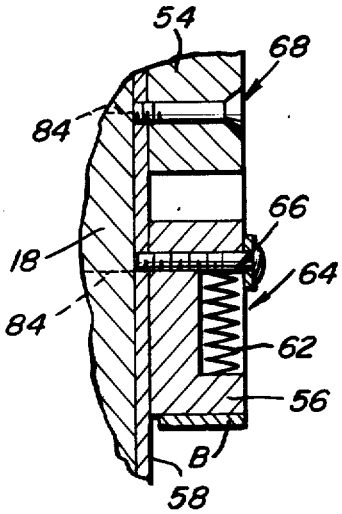
FIG. 7 is a fragmentary, enlarged, sectional view taken generally along the line 7—7 of FIG. 5.

Referring now more particularly to FIGS. 5 and 6 of the drawings, band rewinder 40 includes a spool 52 rotatably mounted on side wall 18 and formed from a pair of half sections 54, 56. Half section 54 is affixed to a back disc 58 rotatably mounted on side wall 18, while half section 56 is slidably mounted on back disc 58 in order to provide tensioning to the roll being formed on spool 52 from the length of band B. A slit 60 is provided in half section 54 for receiving an end of the band B.

Half section 56 is movably mounted on back disc 58 as by provision of a pair of slots 62 disposed extending to and from the half section 54 and having disposed therein coiled compression springs 64 biasing against bolts 66 which retain the half section 56 on the back disc 58. Conventional bolts 68, and the like, may be employed to affix half section 54 to the back disc 58.

A handle 70 is affixed to half section 54 of spool 52 as by the conventional hinge 72 so as to permit removal of the rewound band B from spool 52. Hinge 72 may be attached to half section 54 in a conventional manner, such as by the illustrated screws.

A shaft formed by the shank of the illustrated bolt 74 retained by nut 76 is disposed in an opening 78 provided in side wall 18. A mount disc 80 is provided on the inner surface of side wall 18 so as to abut plate 22 in order to cooperate with the back disc 58 and form a stable yet rotatable mounting. A conventional ball bearing 82, and the like, is advantageously inserted into opening 78 for journaling the shank of bolt 74 and further reducing friction in the rotatable mounting of rewinder 40.

A pair of generally rectangular windows 84 are advantageously provided through the band rewinder 40 on either side of bolt 74 and handle 70 in order to provide for locking of rewinder 40 against rotation as by use of a stop pin to be described below.

A flexible element 86, such as a chain and the like, is mounted on the support member 38 as by a conventional screw 80 and has attached to the free end thereof a suitable stop pin 90. Apertures 92 and 92' are provided in anchor plate 34 and in base member 28 so as to communicate with the bottom of recess 30 such that when one of a plurality of holes 94 provided in the slide 32 is in alignment with the apertures 92, 92', stop pin 90 can be disposed in the apertures 92, 92' and the hole 94 in order to lock slide 32 against movement.

Stop pin 90 can also be selectively disposed in one of the windows 84 for preventing movement of spool 52.

As can be readily understood from the above description and from the drawings, assembly 10 permits the dispensing and rewinding of a length of the banding material on a roll R by pulling on the free end of roll R so that the roll will ride on the tube rollers 26 until a desired length of the banding material has been pulled out of the roll and cut as with a conventional pair of metal shears (not shown). The cut length of band B can now be inserted into the slit 60 and wound onto spool 52 by turning handle 70 in the clockwise direction as seen in FIG. 5. When the entire length of the cut band B is rolled up, a piece of conventional adhesive tape T can be cut from tape dispenser 42 as by use of cutter 46 and applied to the outermost end of the rolled up band B in order to secure the end to the rest of the roll. Handle 70 can now be pivoted about hinge 72 from the full line position shown in FIG. 6 so as to permit removal of the rolled band B.

A roll R may be easily inserted into the receptacle 14 as by being dropped into the receptacle 14 from above, or the whole assembly 10 can be tilted toward the rear or right-hand end thereof and the roll of banding material merely rolled into receptacle 14.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A metal band use facilitating assembly, comprising, in combination:

a. frame means for cooperatively supporting the assembly;

b. receptacle means supported on the frame means for receiving individually rolls of banding material of various widths and diameters; and c. band rewinder means supported on the frame means for winding banding material into rolls which are smaller and more manageable than a roll disposed in the receptacle means.

2. A structure as defined in claim 1, wherein the receptacle means includes first and second semi-circular side walls having opposed surfaces and mounted in spaced relation on the frame means, the opposed surfaces of the side walls being constructed from a low-friction material, and a plurality of tube rollers disposed between the side walls for supporting a roll of banding material and facilitating pulling of the banding material off of the roll and out of the receptacle.

3. A structure as defined in claim 2, wherein the frame means includes, in combination:

1. a longitudinally extending base member provided with a recess disposed transversely of the longitudinal extent of the base member;
2. a slide movably arranged in the recess;
3. anchor means attached to the base member and extending longitudinally over the slide for retaining the slide in the recess; and
4. first and second upstanding support members, the first of the support members being affixed to the base member and arranged straddling the recess, and the second of the support members being aligned with and substantially parallel to the first of the support members and affixed to the slide for movement transverse of the longitudinal extent of the base member to vary the spacing between the support members, the side walls of the receptacle being mounted on the support members and oriented so as to extend parallel to the longitudinal extent of the base member.

4. A structure as set forth in claim 3, wherein the band rewinder means includes a band rewinder and a tape dispenser, the latter providing an adhesive tape for securing an end of a roll to the roll itself, both the band rewinder and the tape dispenser being mounted directly on a side wall of the receptacle means.

5. A structure as defined in claim 4, wherein the frame means further includes a pair of arcuate handles arranged extending transversely of the longitudinal extent of the base member and away from the base member in the same direction as stand the support members, one of the handles being offset toward a side of the base member adjacent to the second support member, the band rewinder being mounted on the side wall attached to the second support member, and the one of the handles forming a guide for banding material being received on the band rewinder.

6. A structure as defined in claim 4, wherein the band rewinder includes, in combination:

1. a spool rotatably mounted on a side wall of the receptacle and provided with a slit for receiving an end of a length of banding material, the spool including a back disc and a pair of half sections, one of the half sections being affixed to the back disc and the other of the half sections being movably mounted on the back disc, and compression spring means for biasing the other of the half sections away from the one of the half sections in order to tension a length of banding material being rewound on the spool; and
2. a turning handle affixed to the one of the half sections of the spool for rotating the spool, the turning handle being hingedly mounted on the one of the half sections for swinging movement to a position extending away from the spool and permitting a rewound length of banding material to be removed from the spool.

7. A structure as defined in claim 6, wherein the frame means further includes a flexible element anchored on the second of the support members, and a stop pin connected to the flexible element, with opposed apertures being provided in the anchor means and in the base member so as to communicate with the recess, and a plurality of holes selectively matable with the opposed apertures being provided in the slide, the apertures and a selected one of the holes forming a through passage, with the stop pin being selectively disposed in the passage for retaining the slide in a predetermined position.

8. A structure as defined in claim 7, wherein the band rewinder is provided with a through window cooperating with a similar window provided in the associated side wall, and the stop pin is selectively disposed in the window for preventing movement of the spool.

9. A rewinding device for lengths of banding material, comprising, in combination:

a. a frame;

b. a spool rotatably mounted on the frame and provided with a slit for receiving an end of a length of banding material to be rewound, the spool including a back disc and a pair of half sections, one of the half sections being affixed to the back disc and the other of the half sections being movably mounted on the back disc, and compression spring means associated with the other of the half sections for biasing the other of the half sections away from the one of the half sections and tensioning a length of banding material being rewound; and c. a turning handle affixed to the one of the half sections of the spool for rotating the spool, the turning handle being hingedly mounted on the one of the half sections for permitting swinging movement of the turning handle and allowing a rewound length of banding material to be removed from the spool.

10. A structure as defined in claim 4, wherein the frame means further includes a flexible element anchored on the second of the support members, and a stop pin connected to the flexible element, with opposed apertures being provided in the anchor means and in the base member so as to communicate with the recess, and a plurality of holes selectively matable with the opposed apertures being provided in the slide, the apertures and a selected one of the holes forming a through passage, with the stop pin being selectively disposed in the passage for retaining the slide in a predetermined position.

11. A structure as defined in claim 10, wherein the band rewinder is provided with a through window cooperating with a similar window provided in the associated side wall, and the stop pin is selectively disposed in the window for preventing movement of the spool.

* * * * *